US005862970A

United States Patent [19]

Cougar

[11] Patent Number: 5,862,970

[45] Date of Patent: Jan. 26, 1999

[54] POWER TOOL AND REPLACEABLE ANTI-SLIP PAD FOR POWER TOOL

[76] Inventor: Daniel Duane Cougar, 13661 Van Dorn Rd., Manassas, Va. 22111

[21] Appl. No.: 834,387

[22] Filed: Apr. 16, 1997

[51] Int. Cl.[6] ..... B25C 7/00; B27F 5/02

[52] U.S. Cl. ..... 227/130; 227/156; 150/161

[58] Field of Search ..... 227/130, 156; 150/154, 161; 30/298.4; 173/DIG. 2

[56] References Cited

U.S. PATENT DOCUMENTS

| | | | |
|---|---|---|---|
| 1,115,704 | 11/1914 | Manes . | |
| 2,152,205 | 3/1939 | Morrison | 173/DIG. 2 |
| 2,207,269 | 7/1940 | Schiff . | |
| 2,425,245 | 8/1947 | Johnson . | |
| 3,554,316 | 1/1971 | Judd et al. | 173/DIG. 2 |
| 3,858,780 | 1/1975 | Perkins et al. | 227/130 |
| 4,907,730 | 3/1990 | Dion | 227/156 |
| 4,981,247 | 1/1991 | Noll . | |
| 5,025,970 | 6/1991 | Anderson et al. | 227/156 |
| 5,065,879 | 11/1991 | King | 150/154 |
| 5,085,449 | 2/1992 | Hudson | 30/298.4 |
| 5,302,124 | 4/1994 | Lansing et al. | 150/154 |
| 5,383,091 | 1/1995 | Snell | 150/154 |
| 5,709,332 | 1/1998 | Coop | 227/156 |

*Primary Examiner*—Scott A. Smith

*Attorney, Agent, or Firm*—Kerkam, Stowell, Kondracki & Clarke, P.C.; John C. Kerins

[57] ABSTRACT

A power tool and a replaceable anti-slip pad for use on sloping surfaces roofers is provided wherein the power tool is provided with a sheet or layer of hook fasteners of the hook-and-loop type fastener system disposed on a side surface thereof, and wherein a replaceable anti-slip pad is provided having a sheet or layer of the complementary loop elements provided on a flat surface thereof. The anti-slip pad is constructed of a high density, closed-cell foam that provides greatly improved traction on roofing surfaces, thereby improving the ability to securely place the tool on the sloping surface without substantial slipping of the tool, which improves worker safety and productivity or efficiency, and provides adequate durability to make the replaceable anti-slip pads cost justifiable, when factoring in the improved productivity. The anti-slip pad is installed and removed from the power tool in the conventional manner in which two object are fastened and unfastened by the use of hook-and-loop fasteners.

9 Claims, 2 Drawing Sheets

POWER TOOL AND REPLACEABLE ANTI-SLIP PAD FOR POWER TOOL

BACKGROUND OF THE INVENTION

1. Field of the Invention

The present invention is directed to a replaceable anti-slip pad for attachment to a power tool, and a power tool equipped with a replaceable anti-slip pad. The pad, and the tool equipped with the pad, are especially well suited for use by roofers and others working on steeply inclined surfaces.

2. Description of Related Art

Roofers and other construction workers that commonly work on steeply inclined surfaces often have difficulty working with their full array of tools, in that it is difficult when working on such sloped surfaces to maintain the tools close at hand. This is especially the case with power tools, such as nail guns or staple guns, in that the power tools cannot be conveniently held in a tool belt, and in that there is generally no flat or stable surface on which to lay the tool for easy access thereto when it is needed on an intermittent basis.

Heretofore, roofers have relied extensively on only the frictional forces between the housing, typically made of aluminum, of the tool and the roofing surface to keep the tool nearby when the tool is laid down so that the roofer can use other necessary tools. This leads to two problems: first, the frictional forces between asphalt shingles and an aluminum power tool housing are generally not great enough to provide a reliable hold, given the steepness of the roof, and second, even minor sliding displacement of the tool, when experienced repeatedly in common use, results in the abrasion and erosion of the power tool housing, oftentimes to the point where the tool is unusable.

This latter problem occurs primarily as a result of the hardness and abrading characteristics of the stone gravel that forms the upper surface of the asphalt shingles, which wears away the generally softer aluminum housing material when the tool housing slides on the roofing surface. The ability of the roofing surface to hold the power tool generally worsens as the housing material wears, in that the worn housing surface generally presents a smoother surface to the roofing surface.

The surfaces that a roofer encounters, such as plywood sheathing, a tar paper interlayer, and the asphalt shingles, are not themselves inherently slippery. It is the slope at which these surfaces are presented, and the fact that the roof is at a considerable distance above ground, that make improved gripping or traction on the angled, oftentimes abrasive, surfaces so important in retaining the tool in the place where it is laid down.

While there are oftentimes foot supports temporarily attached to the roof to provide the roofer with more secure footing, which could potentially provide a better support surface or backstop for the power tool, such supports are inconveniently located where the roofer's feet will be, and not where his hands will be. To date, and to the present inventor's knowledge, no viable solution to the tool slippage problem has been presented to roofers.

Protective coverings for the heads of power tools have been proposed in U.S. Pat. Nos. 4,981,247 and 5,025,970. Those coverings are not designed to protect the head of the power tool from damage, and are not directed to providing the tool housing with an anti-slip capability. Rather, those coverings were designed and are provided for protection of the piece of work, such as a wood baseboard molding, from being damaged by the power tool.

One factor that appears to have been largely overlooked is that a somewhat greater ongoing expense for the power tool over the long-term can be justified if the tool housing has a longer life, and if the tool can maintain good traction such that the efficiency of the roofer or other worker is improved due to the ability to more quickly and ably retrieve the power tool when needed.

It is a principal object of the present invention to provide an anti-slip pad attachment to a power tool that will, when the tool is laid down, substantially prevent the power tool from sliding on an inclined work surface.

It is a further principal object of the present invention to provide an anti-slip pad attachment that is removable and easily replaceable when it becomes worn through extended use.

It is another principal object of the present invention to provide an anti-slip pad attachment that is positioned on a side of the power tool and that is made of a high-density, but also highly resilient, foam material that will deform under the weight of the power tool when the tool is laid down on its side.

SUMMARY OF THE INVENTION

The above and other objects of the present invention are achieved by removably securing a foam pad to an appropriate location on the housing of a power tool such that, when the tool is placed on a surface when not in use, the foam pad will engage the surface and will deform under the weight of the tool, while keeping the housing spaced apart from the surface, such that the pad will securely grip the surface and substantially prevent the tool from sliding along the surface. The removable foam pad is preferably secured to the tool housing by hook-and-loop fasteners, such that, when the foam pad becomes worn, it can be readily replaced by a new pad.

The anti-slip foam pad is not obtrusive to the operation or maintenance of the power tool, in that it is secured to a non-moving, non-operational portion of the tool housing. To obtain the desired anti-slip or gripping properties, while maintaining a reasonable measure of durability, which are two competing interests, it was determined that a high-density, closed-cell foam material provided an excellent combination of these properties.

BRIEF DESCRIPTION OF THE DRAWINGS

These and other features of the present invention and the attendant advantages will be readily apparent to those having ordinary skill in the art and the invention will be more easily understood from the following detailed description of the preferred embodiment taken in conjunction with the accompanying drawings wherein like reference characters represent like parts throughout the several views.

DETAILED DESCRIPTION OF THE PREFERRED EMBODIMENTS

Figure 1:
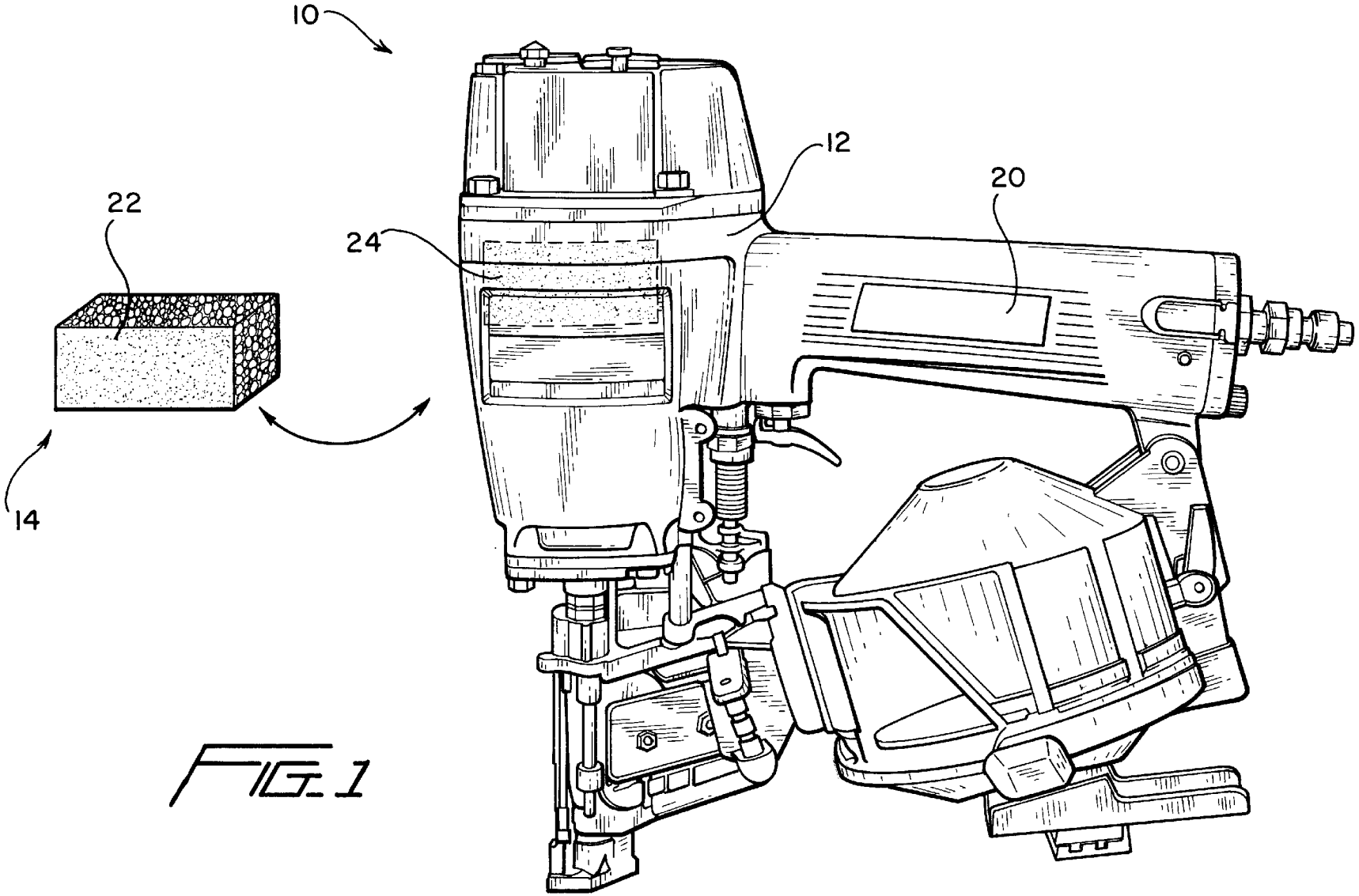
FIG. 1 is a side view of a power tool and a replaceable anti-slip pad which is to be secured thereto.
Figure 2:
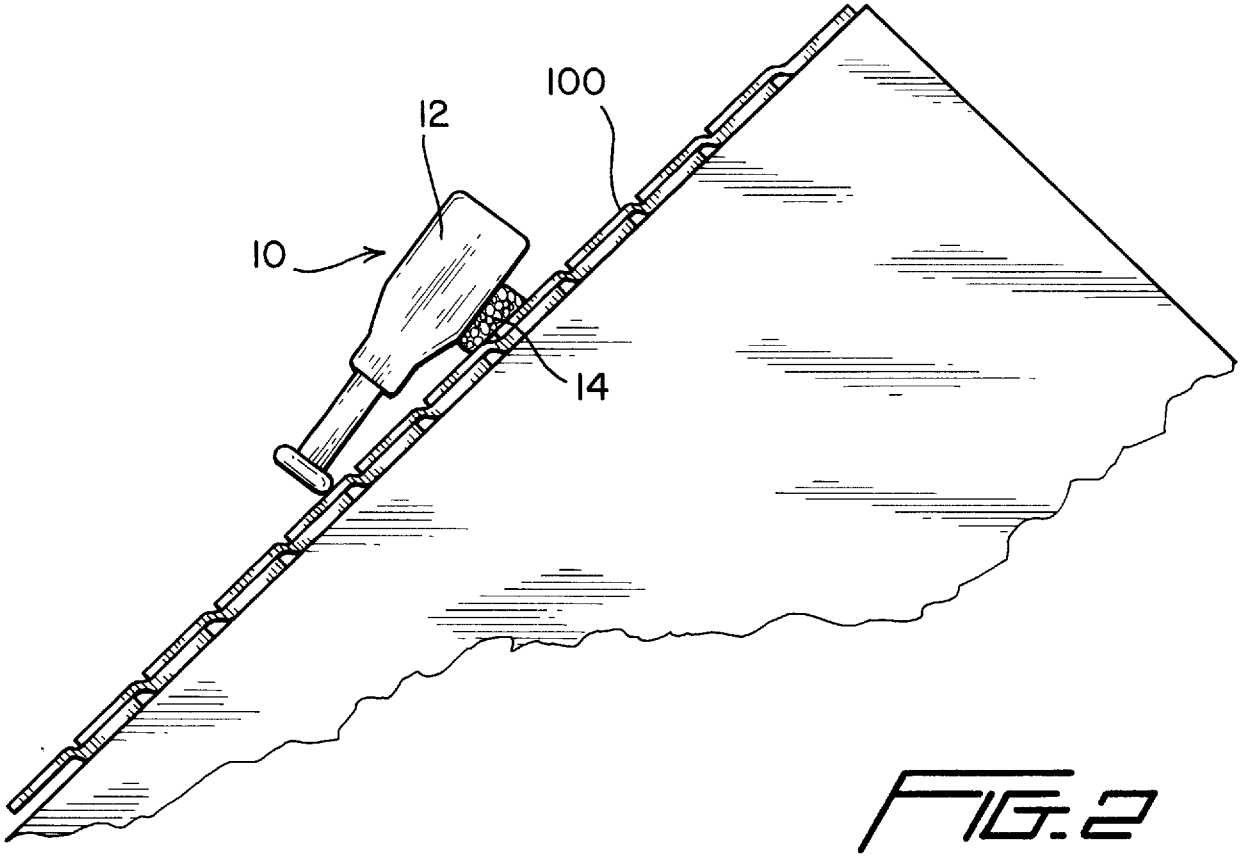
FIG. 2 is a partial front view of a power tool having a replaceable anti-slip pad secured thereto, wherein the power tool is laid on its side on a sloping surface.

Referring to FIGS. 1 and 2, a typical power tool 10 of the type to which the present invention is directed is illustrated. The specific tool shown is referred to as a coil nailer 10, a coil-fed pneumatic nailer, or simply a nail gun. Other power tools 10 for which this invention would be especially well-suited include automatic or pneumatic staple guns, power drills, and the like.

Nail guns 10 are frequently used by roofers to secure backing paper and asphalt shingles to the plywood roof sheathing. In performing such work, the roofer will periodically need to let go of the nail gun 10 to place roofing materials in the proper position for nailing, or to move himself to a different position on the roof, or for various other reasons. Typically, the roofer simply lays the nail gun 10 down on its side on the sloped roof surface 100. It would be impractical, unproductive and unsafe for a roofer to seek out a flat surface on which to put the nail gun down every time the necessity arose. However, frequently, the nail gun will slide down the sloping surface for anywhere from a short distance to a long distance down the roof.

The slipping or sliding of the nail gun 10 leads to at least two serious problems, firstly, it requires the roofer to move to retrieve the nail gun, thus decreasing worker efficiency and increasing the risk of accidents. Secondly, the housing or casing 12 of the nail gun is gradually worn thin or worn through by the abrading action of the hard particles of the asphalt shingles on the nail gun housing 12. The nail gun housing 12 is generally made of aluminum, which is softer than the stone gravel surface of the shingle.

The present invention avoids the problems associated with using a nail gun or other power tool on a sloped surface by providing a removable and replaceable high density, closed-cell foam pad 14 secured to the surface of the power tool that would normally be in contact with the sloped surface when the tool is placed on the surface. In most instances, the configuration and weighting of the power tool 10 is such that the tool will lay on its side when placed on a surface. Therefore, the generally preferred location for placement of the anti-slip pad 14 is on the side of the housing 12 of the power tool 10.

When the roofer lays down the nail gun 10 on its side when not in use, the anti-slip pad 14 engages the roof surface, whether it is the bare plywood sheathing, the backing paper, or, most often, the gravel surface of an asphalt shingle. Although the material for the pad is selected to be a high density foam material, it is also selected to be substantially resilient, such that the weight of the power tool will cause the foam pad to deform under the weight of the tool, to securely engage the roof surface, and to increase the area of contact and frictional forces between the roof surface and the pad 14.

Preferably, the anti-slip pad 14 will cover only a minor portion of the side of the power tool 10, and preferably at the wider head of the power tool 10. A typical size for the anti-slip pad may be one inch by one-and-one-half inches, although the size may vary considerably, and can be selected based upon the tool configuration. The pad will preferably not extend into the way of, nor interfere with, the grip area 20 of the tool 10, or any portion of the tool 10 that requires frequent maintenance. The anti-slip pad further is preferably positioned so as to not interfere with the ability to observe the position of the portion of the tool 10 where the work is actually performed, for example, at the head of the nail gun where the nails or staples are discharged into an underlying surface.

Anti-slip pad 14 is preferably constructed of a closed-cell foam material, having a density in the range of about 1.5 to about 30 pounds per cubic foot (lb/ft.$^3$).

An even more preferred range of densities for the closed-cell foam is between about 4.5 lb/ft.$^3$ and 16 lb/ft.$^3$, as products in that range are believed to provide a very desirable combination of high traction and Is suitably long wear, so that the pad need be replaced only infrequently.

Several types of foam material should be suitable for use, provided that they are closed-cell in nature and have a high density for closed-cell foams. Neoprene, Vinyl Nitrile, Styrene-Butadiene Rubber (SBR), Polyethylene (PE), ethyl vinyl acetate (EVA), ethylene propylene terpolymer (EPT), EPT/PE/ButylRubber, Neoprene/EPT/SBR, epichlorohydrin (ECH), an nitrile (NBR) are among the types of polymers that would provide suitable closed-cell foam layers for use as an anti-slip pad 14 in the present invention. Neoprene and vinyl/nitrile appear to be the most promising polymers among the above polymers, at the present time.

Certain closed cell foams having the preferred characteristics noted above are commercially available through the Rubatex® company. Among the closed-cell foam products currently available through Rubatex, the products sold under the designations R-411-N (10–16 lb/ft.$^3$), R-1800-FS (4.5–8.5 lb/ft.$^3$), G-207-N (15–30 lb/ft.$^3$) and G-231-N (10–20 lb/ft.$^3$), are believed to be particularly suitable for use as anti-slip pads 14 in the present invention.

The high density and closed cell characteristics of the foam material are believed to be critical features in terms of providing the necessary anti-slip characteristics for the anti-slip pad, as well as providing a desirable degree of durability as used in the roofing applications.

Various harder (less resilient) and softer (more resilient) materials have drawbacks that render them unsuitable for providing an anti-slip pad for a power tool used by roofers and other persons working on roofs and other sloping surfaces. A non-foamed polymer material, for example, will generally lack sufficient resiliency or ability to deform under the weight of the power tool, and will thus not adequately grip the surface. The closed cell foam employed as the anti-slip pad 14 in the present invention provides greatly improved anti-slip characteristics, and the resiliency and softness (relative to the hardness of the gravel particles on the shingles) of the material allows the foam material to deform around the gravel particles and to securely grip the asphalt shingles. The anti-slip pad is able to conform to the rough, irregular surface by deforming around the gravel particles, instead of simply pushing against the particles, and possibly dislodging them in the process, which is how traction is achieved between the aluminum housing of a power tool and the shingle surface.

Closed-cell foam material, in general, appears to have a greater resistance to wear when used on shingles and roofing surfaces, as compared to open-cell foams that have previously been studied. The use of a high-density closed-cell foam for the removable anti-slip pad 14 thus provides the advantage of increased wear life. The high-density closed-cell foam anti-slip pads will also stand up reasonably well to other abrasive surfaces onto which the power tool 10 may be placed in a typical day, such as concrete sidewalks, and concrete or asphalt driveways.

The fastening means for the anti-slip pad 14 is preferably a sheet or layer 22 of the loop elements of a hook-and-loop type fastener substantially permanently secured to the anti-slip pad 14 by adhesive or other suitable means. One expected preferred manner of effecting a permanent securement of sheet 22 to anti-slip pad 14 is to laminate sheet 22 onto the foam layer 14 as the foam layer is being produced. The power tool 10 will have secured thereto a corresponding sheet 24 of hook-type fasteners, at a location where the pad 14 is to be secured. The sheet 24 of hook-type fasteners is desirably secured to the housing 12 of the tool with a long-lasting adhesive, such as an epoxy-based adhesive. Fastening means other than hook-and-loop fasteners may be employed in place of the hook-and-loop fasteners.

The preferred thickness of the anti-slip pad 14 is in the range of ¼ inch to ¾ inch. If the anti-slip pad were thinner than ¼ inch, the anti-slip pad might not provide sufficient service life when used on a daily basis, as the foam will gradually be worn away by the shingles. Anti-slip pads thicker than ¾ inch would provide even greater service life, but at the expense of making the pad 14 overly thick and possibly obtrusive to operation of the power tool.

When the pad 14 becomes worn as a result of being abraded away during extended use, the work pad 14 may be removed and a new pad 14 having a sheet 22 of the necessary type of fastening means may be secured to the complementary fastening means 24 previously secured to the housing 12.

It will be apparent to those skilled in the art that modifications and variations can be made to the anti-slip pad and power tool having an anti-slip pad of the present invention, without departing from the scope or spirit of the present invention. Thus, it is intended that the present invention cover such modifications and variations of the invention, provided they come within the scope of the appended claims and their equivalents.

What is claimed is:

1. A power tool comprising:

a substantially rigid power tool housing, an anti-slip pad constructed of a high-density, closed cell foam material, said anti-slip pad having a first fastening element secured to a surface thereof;

a second fastening element secured to a side portion of said power tool housing at a position that will not interfere with the operation of the power tool;

said anti-slip pad being of a sufficiently small size and being removably secured to said second fastening element at a position whereby said pad will not interfere with the normal operation of said power tool.

2. A power tool as recited in claim 1, wherein said power tool housing, when said power tool is in its operational position, has a height greater than a width thereof.

3. A power tool as recited in claim 2 wherein said anti-slip pad is approximately 1½ inches square, and has a thickness in the range of about ¼ inch to ¾ inch.

4. A power tool as recited in claim 1 wherein said anti-slip pad is constructed of a foam having a density in the range of about 1.5 lb/ft.$^3$ to about 30 lb/ft.$^3$.

5. A power tool as recited in claim 4 wherein said anti-slip pad is constructed of a foam having a density in the range of about 4.5 lb/ft.$^3$ to about 16 lb/ft.$^3$.

6. A power tool as recited in claim 5 wherein said anti-slip pad is constructed of a foam having a density in the range of about 4.5 lb/ft.$^3$ to about 8.5 lb/ft.$^3$.

7. A power tool as recited in claim 4 wherein said anti-slip pad is constructed of a foam having a density in the range of about 10 lb/ft.$^3$ to about 30 lb/ft.$^3$.

8. A power tool as recited in claim 1 wherein said fastener element on said anti-slip pad is a loop-type fastener formed on a sheet backing material, and wherein said anti-slip pad is laminated thereto when said anti-slip pad is initially formed.

9. A power tool as recited in claim 1 wherein said anti-slip pad has a thickness in the range of about ¼ inch to about ¾ inch.

* * * * *